United States Patent [19]

McGraw

[11] 4,326,436

[45] Apr. 27, 1982

[54] COMBINATION ADJUSTABLE/LOCKABLE/MEASURING WRENCH, AND METHODS OF CONSTRUCTING AND UTILIZING SAME

[76] Inventor: Val R. McGraw, 19130 Beaverland, Detroit, Mich. 48219

[21] Appl. No.: 75,696

[22] Filed: Sep. 14, 1979

[51] Int. Cl.[3] ..... B25B 13/16

[52] U.S. Cl. ..... 81/165; 81/DIG. 3

[58] Field of Search ..... 81/165, 170, DIG. 3

[56] References Cited

U.S. PATENT DOCUMENTS

| | | | |
|---|---|---|---|
| 2,714,323 | 8/1955 | Lyons | 81/165 |
| 3,183,744 | 5/1965 | Bowman | 81/165 |
| 3,948,120 | 4/1976 | Hancock | 81/165 |

*Primary Examiner*—James G. Smith

*Attorney, Agent, or Firm*—Irving M. Weiner; Pamela S. Burt; John L. Shortley

[57] ABSTRACT

A combination adjustable/lockable/measuring wrench which enables the user of the wrench to operate, with the same hand that is holding the wrench, a push button for selectively locking and unlocking the wrench jaws in any desired position. The push button controls an over center linkage which controls the legs of a U-shaped brake shoe for selectively gripping and ungripping the wrench worm gear shaft. On one side of the wrench jaws there is provided an inch scale for measuring various bolts and nuts. On the opposite surface of the wrench jaws there is provided an inch scale for measuring such bolts and nuts but on a metric scale, rather than on an inch scale.

8 Claims, 8 Drawing Figures

COMBINATION ADJUSTABLE/LOCKABLE/MEASURING WRENCH, AND METHODS OF CONSTRUCTING AND UTILIZING SAME

The present invention relates generally to lockable adjusting wrenches. More particularly, the present invention relates to a combination adjustable/lockable/-measuring wrench which can be selectively locked and/or unlocked in any desired position within the range of movement of a movable jaw thereof, and by the use of the same hand of the operator or user of the wrench which is holding the wrench itself.

BACKGROUND OF THE INVENTION

Heretofore, various attempts have been made to achieve a wrench whose jaws could be locked readily in any desired position. Such previous attempts have proved to be significantly less than successful, especially with respect to ease of operation, simplicity of mechanism, ability to operate by the use of one hand only, and the ability to hold and maintain the desired adjusted position.

Without dwelling inordinately on the animadversions of the prior art attempts, there is nevertheless set forth hereinbelow a terse and cursory discussion of several exemplary prior art attempts.

Anderson U.S. Pat. No. 1,846,380, entitled "WRENCH", discloses a wrench wherein one end of the worm shaft functions as a push-to-adjust button. Pushing such button overcomes the spring tension which holds a key or locking member 23 within one of the grooves 28 in an end of the worm gear, and thereby allows the worm gear to rotate. The disclosed Anderson wrench appears to have a single scale 29 which is divided into fractions of an inch to indicate the distance between the opposing wrench jaws.

In contrast to the present invention, the jaws of the Anderson wrench are not capable of being locked in an infinite number of positions. Rather, the Anderson jaws may only be locked in a position where the key or locking member 23 is able to fit within or engage in associated group 28 in the worm gear end.

Truby U.S. Pat. No. 2,385,660, entitled "LOCKING WRENCH" discloses an infinitely-variable adjustable wrench which is provided with a shaft which is mounted in a fixed position upon which a worm gear is normally free to rotate. One end of the shaft is internally threaded to receive a knurled-head thumbscrew. Turning the thumbscrew into the shaft forces a ball bearing against the inside diameter of the worm gear, jamming the worm gear against the jaw rack and forcing the worm gear into a cocked position. The worm gear is spring-loaded against one side of the opening.

In contrast to the present invention, the Truby worm gear is not truly free to turn in the unlocked position, because it is spring-loaded against one end of the adjusting opening, and the shaft is not free to turn. Furthermore, there is no way to unlock and lock the wrench with the hand that is holding the wrench, and there is no preset locked position nor a preset unlocked position.

Johnson U.S. Pat. No. 2,719,449, entitled "OPEN END WRENCH LOCKING MEANS", discloses a wrench locking means wherein there is mounted an adjusting screw or worm upon a slidable shaft which is adapted to be held in either of two adjustable limiting positions by spring means which also function to hold the wrench parts in assembled relation. The Johnson worm 18 has a bore therethrough which, for at least a portion of its length, is in the shape of a polygon having a number of sides which is an integer multiple of the number of sides of the shaft 19 to provide a non-rotative engagement therewith, and a second portion 25 of the bore is of an enlarged diameter to permit rotatable fit across the corners of the polygonal shaft.

In contrast to the Johnson disclosure, the present invention provides a shaft and a worm which are connected together as an integral unit so as to rotate as an integral unit or to be locked together as an integral unit and to prevent any slidable movement between the shaft and the worm under all conditions and at all times.

Barnes U.S. Pat. No. 2,729,999, entitled "ADJUSTING AND LOCKING MEANS FOR SLIDABLE JAW WRENCH", discloses a wrench with a shaft having hexagonal portions that may be engaged with hexagonal portions of a shaft bore in the wrench body.

In contrast to the present invention, the jaws of the Barnes wrench can be adjusted only to discrete positions where a hexagonal shaft and splined hole are in alignment, and is not useable where, for example, both English and metric bolt heads or nuts must be closely gripped, or where a non-symmetrical, non-standard or irregular surface must be closely and tightly gripped and turned.

Heuser U.S. Pat. No. 2,817,259, entitled "ADJUSTMENT LOCKING MEANS FOR ADJUSTABLE JAW WRENCHES", discloses a wrench having a shaft with hexagonal ends slidable in hexagonal holes in the wrench body. The shaft engages with an internally-splined portion of the worm gear in locked position. The Heuser device uses a simple rubber housing to serve to retain the shaft in the wrench body.

Again, in contrast to the present invention, the jaws of the Heuser wrench can be locked only in a discrete position where the hexagonal shaft and the splined worm gear bore are in alignment. In other words, the jaws of the Heuser wrench cannot be locked in an infinite number of positions.

The present invention provides an improved wrench which is superior to the devices discussed hereinabove, and also which has beneficial advantages and features mentioned hereinbelow.

SUMMARY OF THE INVENTION

The present invention provides a wrench comprising a head having a fixed first jaw, and a second jaw movable in the head and having a rack. The shaft is rotatably mounted in the head. A worm is mounted on the shaft for rotation therewith and for measuring with the rack. The wrench includes means having a preset unlocked position and a preset locked position for selectively unlocking and locking the jaws in any desired position within the range of movement of the movable second jaw. The shaft and the worm are connected together as an integral unit so as to rotate as an integral unit or to be locked together as an integral unit and to prevent any slidable movement between the shaft and the worm under all conditions and at all times. The shaft and the worm are completely free to rotate as an integral unit when such means is in its preset unlocked position. The shaft and the worm are locked together as an integral unit to prevent rotation thereof when such means is in its preset locked position. The locking and unlocking means is configured and arranged to permit operation of such means to its preset locked position and to its preset unlocked position by the same hand of the user which is holding the wrench.

One object of the present invention is to provide a lockable adjusting wrench of the type described hereinabove, which wrench will hold the selected jaw positioning even after contacting or impacting with external objects.

Another object of the present invention is to provide a lockable adjusting wrench which operates by frictionally engaging the worm gear shaft with a U-shaped shoe, and squeezing the legs of the U together.

Another object of the present invention is to provide a wrench of the type described hereinabove which has a push button disposed substantially perpendicularly to the elongated longitudinal axis of the worm gear shaft, and which operates an over center linkage which forces the legs of the U-shaped shoe together.

An alternate embodiment of the present invention employs a nut and screw to draw the legs of the U-shaped shoe together. A spur gear may, if desired, serve as the nut. A crown gear, driven through a spring-loaded, one-way positive ratchet assembly from a push-to-turn knob, drives the spur gear. A spring may set the ratchet force so that the ratchet slips when the U-shaped shoe is sufficiently tight.

A further modification of the alternate embodiment mentioned hereinabove may optionally include a crown gear driven from a push-to-turn knob, wherein the ratchet could be eliminated.

Another modification may include a spur gear driven by a rack attached to a thumb slide lever.

The present invention also contemplates wrench jaws having a conventional English measuring scale on one side thereof, and a metric measuring scale on the other side thereof, to aid in presetting the opening, or to allow the use of a wrench as a convenient measuring apparatus.

The present invention provides a combination adjustable/lockable/measuring wrench, and methods of constructing and utilizing same, which entails a combination of elements or components which so cooperate as to produce a new and useful result, and a substantial increase in efficiency.

The foregoing and other objects and advantages of the present invention will become apparent from the ensuing disclosure in which a preferred embodiment of the present invention is described in detail and illustrated in the accompanying drawings in which like parts are designated by like reference numerals. It is contemplated that variations in structural features and arrangement of parts thereof may occur to the skilled artisan without departing from the spirit of the present invention and without sacrificing any of the advantages or objects of the present invention.

DETAILED DESCRIPTION OF A PREFERRED EMBODIMENT

Before explaining the present invention in detail, it is to be understood that the present invention is not to be limited or restricted in its construction or application to the details of construction and arrangement of parts as illustrated in the accompanying drawings, because the present invention is capable of other embodiments and of being practiced and carried cut in various other ways. Furthermore, it is to be understood that the phraseology and terminology employed herein is for the purpose of description and illustration only, and not for the purpose of restriction or limitation.

Figure 1:
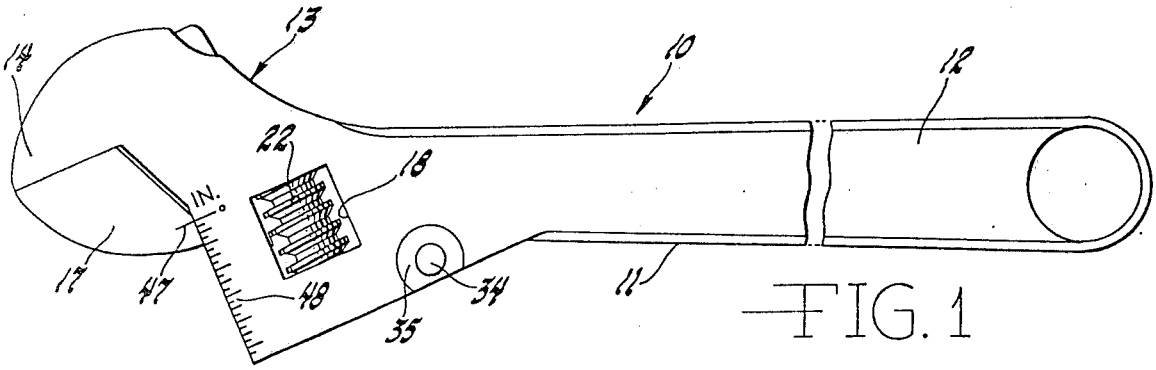
FIG. 1 illustrates a side elevational view of a preferred embodiment of the present invention showing the wrench with its jaws in a fully closed position.

With reference to FIG 1, there is illustrated a wrench 10 having a body portion 11 which includes a handle 12 and a head 13 having a fixed integral first jaw 14. The outer edge of head 13 adjacent to the fixed jaw 14 is formed with a T-slot 15 (see FIGS. 4 and 5) which provides a guide channel for an enlarged rib or bead formation 16 which comprises a part of an adjustable second jaw 17 which is movable within the head 13.

Figure 2:
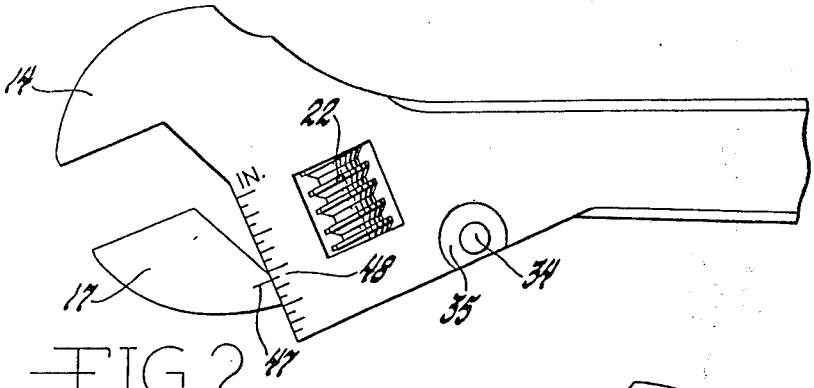
FIG. 2 illustrates a portion of the FIG. 1 embodiment showing the wrench jaws partially open.
Figure 4:
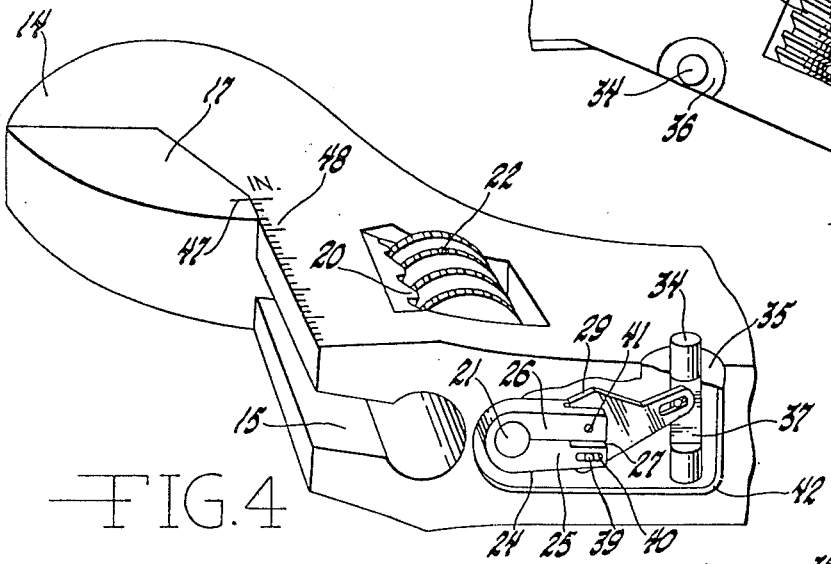
FIG. 4 illustrates an exploded perspective view, with a portion broken away to show the inner mechanism of the head portion of the FIG. 1 embodiment.

The head 13 of the wrench is provided with a rectangular opening 18 which receives an adjusting worm 19 that meshes with rack teeth 20 formed along the rib or bead formation 16 of the movable second jaw 17. The worm 19 is rigidly secured to a shaft 21 (see FIG. 4), which preferably has a substantially constant diameter and preferably is of solid construction. The shaft 21 is rotatably mounted within the head 13. A roll pin 22, which is illustrated in FIGS. 1, 2 and 4, rigidly affixes and connects the shaft 21 and worm 19 together to act as an integral unit so as to rotate as an integral unit or to be locked together as an integral unit and to prevent any slidable movement between the shaft 21 and the worm 19 under all conditions and at all times. The roll pin 22 is disposed into and through the adjusting worm 19 and the shaft 21.

The wrench 10 is provided with novel means, described in detail hereinbelow, having a preset unlocked position and a preset locked position for selectively locking and unlocking the jaws 14 and 17 in any desired position within the range of movement of movable jaw 17. In other words, the novel wrench 10 is not restricted to a limited number of discrete locking positions are several of the prior art wrenches.

It is also significant to note that the aforementioned means are configured and arranged to permit operation of such means to its preset locked position and to its preset unlocked position by the same hand of the user which is holding the wrench 10. This feature and advantage of the present invention will become eminently clear from the further detailed explanatory material set forth hereinbelow.

Figure 6:
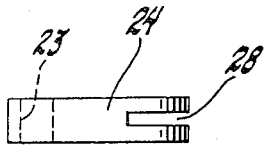
FIG. 6 illustrates a side elevational view of the novel U-shaped brake shoe.

With reference to FIGS. 4 and 6, the lower portion of the rotatable shaft 21 is enclosed within an annular opening 23 formed within one end of a U-shaped brake shoe 24. The brake shoe 24 is provided with split legs 25 and 26 which may be selectively squeezed together to tightly and frictionally lock the shaft 21 within the annular opening 23 of the shoe 24 when desired. The view as depicted in FIG. 4 shows the device in the unlocked preset position with a small space 27 between the split legs 25 and 26.

Figure 7:
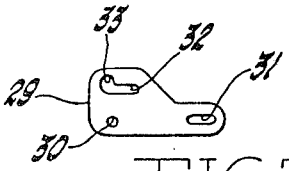
FIG. 7 illustrates a top plan view of a novel actuator squeeze lever.
Figure 3:
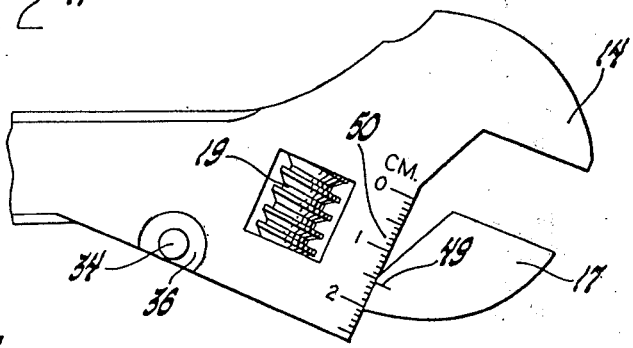
FIG. 3 illustrates a portion of the FIG. 1 embodiment showing the wrench jaws partially open, and illustrating the metric scale on the reverse side of the FIG. 1 embodiment.

As best seen in FIG. 6, the U-shaped brake shoe 24 is also provided with a guide channel 28 for accommodating an actuator squeeze lever 29 which is illustrated in FIGS. 7 and 4.

As mentioned hereinabove, the actuator squeeze lever 29 operates as an over center linkage for forcing the legs 25 and 26 of the brake shoe 24 together, or ultimately for separating such legs. The actuator squeeze lever 29 is provided with a circular opening 30, a rectangular opening 31, and a rectangular or arcuate opening 32 provided with a detent 33.

With reference to FIGS. 1, 2, 3, 4, 5 and 8, the wrench 10 is provided with a novel push button rod 34 the ends of which are disposed within or protrude from thumb or finger relief portions 35 and 36.

Figure 8:
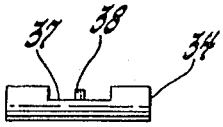
FIG. 8 illustrates a side elevational view of the novel locking and unlocking push button.

As shown in FIGS. 8 and 4, the push button rod 34 is provided with a central flat portion 37 from which protrudes a throw pin 38. As shown in FIG. 4, the rectangular opening 31 in the actuator squeeze lever 29 is disposed around and engages with the throw pin 38 of the push button rod 34.

With reference to FIG. 4, a pin 39 passes through a rectangular slot 40 in the brake shoe leg 25, and through the circular opening 30 in the squeeze lever 29, and is press-fitted into the wrench body. This pin 39 serves as the pivot point for squeeze lever 29. One purpose of the rectangular slot 40 is to provide for and accommodate any side-to-side movement in the adjusting axle or shaft 21.

Another pin 41 passes through the brake shoe leg 26 and through the opening 32 in the squeeze lever 29. This pin 41 does not pass into the wrench body proper. The U-shaped brake shoe 24 pushes down against the throw arm or squeeze lever 29, which in turn pushes against the flat spot 37 on the push button rod 34.

The wrench 10 is shown in the preset unlocked position in FIG. 4 with the push button rod 34 protruding out of the relief portion 35. With the thumb or another finger of the same hand of the user holding the wrench 10, the rod 34 may be depressed to swing the squeeze lever 29 clockwise as viewed in FIG. 4 and thereby squeezing the legs 25 and 26 together to tightly grip and lock the shaft 21 within the shoe 24. With reference to FIG. 4, there is provided a slight step 42 to accommodate a crimp cover plate 43 shown in FIG. 5. Effectively, the slight step 42 regulates the cover depth after crimping.

Figure 5:
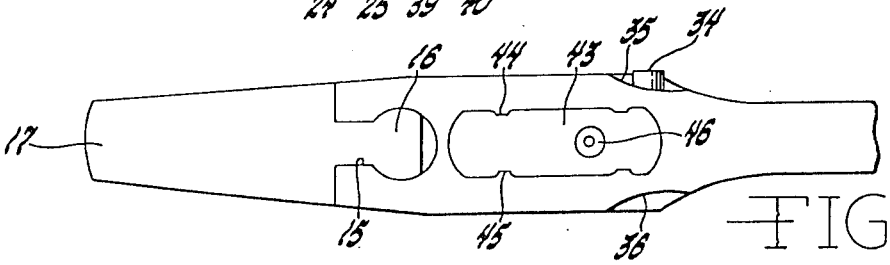
FIG. 5 illustrates a bottom plan view of the wrench as oriented in the position shown in FIGS. 1, 2 and 4.

As shown in FIG. 5, the cover plate 43 is provided with the opposing crimps 44 and 45, and an optional flush-type grease fitting 46.

As shown in FIGS. 1, 2 and 4, the movable jaw 17 is provided with an index line 47 for indicating a bolt head or nut measurement in inches on an inch scale 48. On the other side of the wrench head 13, there is provided an index marking 49 for lining up with an appropriate centimeter or millimeter scale 50.

I claim:

1. A wrench comprising:

a head having a fixed first jaw;

a second jaw movable in said head and having a rack;

a shaft rotatably mounted in said head;

a worm mounted on said shaft for rotation therewith and for meshing with said rack;

means having a preset unlocked position and a preset locked position for selectively unlocking and locking said jaws in any desired position within the range of movement of said second movable jaw;

said shaft and said worm being connected together as an integral unit so as to rotate together as an integral unit and to be locked together as an integral unit and to prevent any slidable movement between said shaft and said worm under all conditions and at all times;

said shaft and worm being completely free to rotate as an integral unit when said means is in its preset unlocked position;

said shaft and worm being locked together as an integral unit to prevent rotation thereof when said means is in its preset locked position;

said means including a brake member operatively cooperating with said rotatable shaft, and a lever connected between said brake member and a translatable push button rod;

said means being configured and arranged to permit operation of said means to its preset locked position and to its preset unlocked position by translation of said push button rod by the same hand of the user which is holding said wrench; and said brake member being actuatable, by operation of said lever caused by selective translation of said push button rod, to tightly frictionally engage said rotatable shaft to place said wrench in said locked position.

2. A wrench according to claim 1, wherein:

said head is provided on a first major surface thereof with an inch measuring scale for indicating the distance between said first and second jaws; and said head is provided on an opposing major surface thereof with a metric measuring scale for indicating the distance between said first and second jaws.

3. A wrench according to claim 1 wherein:

said brake member comprises a U-shaped brake shoe having an annular opening therein which encloses one end of said rotatable shaft; and said U-shaped brake shoe is provided with split legs which may be selectively squeezed together by operation of said lever in response to selective translation of said push button rod to cause a tight frictional engagement between said annular opening and said rotatable shaft to place said wrench in said locked position.

4. A wrench according to claim 1, wherein:

said push button rod is linearly translatable and has a flat central portion with a protruding throw pin;

said lever comprises an actuator squeeze lever provided with a circular opening, a rectangular opening, and a third opening having a detent therein;

said brake member comprises a U-shaped brake shoe having split legs therein;

said throw pin protrudes through and engages in said rectangular opening in said actuator squeeze lever;

said actuator squeeze lever is pivotably retained at one end thereof within said brake shoe by means of a pin passing through said circular opening in said squeeze lever; and said push button rod is actuatable by the user of the wrench to translate the push button rod to a position which pivots said squeeze lever about said pin to cause the legs of the brake shoe to squeeze together with a resultant tight gripping of the rotatable shaft within an annular opening provided in one end of said brake shoe to place the wrench in said locked position.

5. A wrench according to claim 4, wherein:

said actuator squeeze lever operates as an over center linkage which forces the split legs of the brake shoe together when it is desired to lock the rotatable shaft in said preset locked position.

6. A wrench according to claim 4 or 5, wherein:

said wrench is provided with finger relief portions adjacent the ends of said translatable push button rod.

7. A wrench according to claim 2, wherein:

said second movable jaw is provided with index markings on opposite sides thereof for operable cooperation with said inch and metric scales.

8. A wrench according to claim 3, wherein:

said lever is pivotably connected to said push button rod so as to pivotably move in response to translation of said push button rod;

said lever is pivotably connected at one end thereof to said brake shoe so as to squeeze said legs of said brake shoe together when said lever is pivotably moved in response to translation of said push button rod so as to cause said tight frictional engagement between said annular opening of said brake shoe and said rotatable shaft to place said wrench in said locked position.

* * * * *